US006948984B2

(12) United States Patent
Chen et al.

(10) Patent No.: US 6,948,984 B2
(45) Date of Patent: Sep. 27, 2005

(54) POWER CONNECTOR WITH IMPROVED CONTACT STRUCTURE

(75) Inventors: Wei-Xing Chen, Kunsan (CN); Quan Zhuang, Kunsan (CN); Ning Wang, Kunsan (CN); Zhi-Qiang Chen, Tu-chen (TW); Ya-Lei Xue, Kunsan (CN); Bin Peng, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/000,755

(22) Filed: Nov. 30, 2004

(65) Prior Publication Data

US 2005/0124219 A1 Jun. 9, 2005

(30) Foreign Application Priority Data

Dec. 6, 2003 (CN) ..... 2003201203532

(51) Int. Cl.[7] ..... H01R 24/00
(52) U.S. Cl. ..... 439/660; 439/607
(58) Field of Search ..... 439/660, 607, 439/733.1

(56) References Cited

U.S. PATENT DOCUMENTS 5,158,471 A 10/1992 Fedder et al.
5,295,843 A 3/1994 Davis et al.
6,039,583 A * 3/2000 Korsunsky et al. ..... 439/101
6,183,300 B1 * 2/2001 Belopolsky et al. ..... 439/607
6,394,846 B1 * 5/2002 Belopolsky et al. ..... 439/620
6,461,174 B1 10/2002 Hwang et al.
6,719,594 B1 * 4/2004 Yuzawa ..... 439/862
6,755,689 B2 * 6/2004 Zhang et al. ..... 439/607

* cited by examiner

*Primary Examiner*—Tho D. Ta
(74) *Attorney, Agent, or Firm*—Wei Te Chung

(57) ABSTRACT

A power connector (1) includes an insulating housing (10), a number of contacts (20) received in the insulative housing, a first and a second shielding shells (30,40). The insulating housing has a base (101), and a tongue (103) extending horizontally from the base and including an upper mating face (1031) and a lower mating face (1032) parallel to the upper mating face. A number of receiving passages (105) are defined through the base toward the tongue. A plurality of receiving slots (104) extend from the upper mating face to the lower mating face to communicate with corresponding receiving passages. Each contact has a contact portion (201) received in corresponding receiving slot. The contact portion has a first and a second contact surfaces (202, 203) respectively exposed in the upper and the lower mating face.

11 Claims, 8 Drawing Sheets

POWER CONNECTOR WITH IMPROVED CONTACT STRUCTURE

BACKGROUND OF THE INVENTION

1. Field of the Invention

The present invention generally relates to a power connector, and particularly to a power connector having improved contact structure.

2. Description of Prior Arts

With the development of integrated circuits, the trend toward high density of components used in electronic packaging, such as those used for computers and the like, is continuing. Thus, there are the needs for power connectors to carry the power required by densely spaced logic and memory components and to insure the electrical connection of the contacts for avoiding the risk of shorting. In response to the need to carry different levels of voltage current, power connectors with multi-contacts capabilities are fabricated. U.S. Pat. No. 5,158,471 disclosed such a power connector. The power connector for interconnecting power between printed circuit boards includes plug and receptacle contacts, which are arranged adjacent to signal connector halves mounted on the circuit boards. Insulating housing of the plug and receptacle contacts are provided to preclude accidental shorting as between multiple contacts. However, the insulating housing of the plug contacts is configured in an L-shape and the plug contacts are mainly exposed to the air and the separated space between the contacts is small such that if there is metal thing dropt into the plug, accidental shorting will happen between multiple contacts also. In addition, the electrical contact is unsure between contacts of the power connector and mating contacts of a complementary connector for small contact surfaces of the contacts.

Hence, an improved power connector is desired to overcome the problems encountered in the related art.

BRIEF SUMMARY OF THE INVENTION

Accordingly, an object of the present invention is to provide a power connector, which has multiple contacts to achieve high current carrying capability.

In order to achieve the above-mentioned object, a power connector in accordance with the present invention includes an insulating housing, a plurality of contacts received in the insulative housing and a conductive shield comprising a first shielding shell and a second shielding shell. The insulating housing has a base, a tongue extending horizontally from the base and comprising a upper mating face and a lower mating face parallel to the upper mating face, and a pair of mounting portions adjacent to the base. A plurality of receiving passages are defined through the base toward the tongue for receiving the contacts. A plurality of receiving slots extend from the upper mating face to the lower mating face and communicate with corresponding receiving passages. Each of the contacts has a contact portion received in corresponding receiving slot and the contact portion comprises a first and a second contact surfaces respectively exposed to the upper mating face and the lower mating face. The contacts are surrounded by the insulative housing and distributed along the receiving passages and slots, with plastic of the housing separating one contact from the other to preclude accidental shorting as between multiple contacts. As the power connector mates with a complementary connector, the first and the second contact surfaces of the contacts enlarge contact surface area, thereby to insure electrical connection between connectors.

Other objects, advantages and novel features of the invention will become more apparent from the following detailed description of the present embodiment when taken in conjunction with the accompanying drawings.

DETAILED DESCRIPTION OF THE INVENTION

Figure 1:
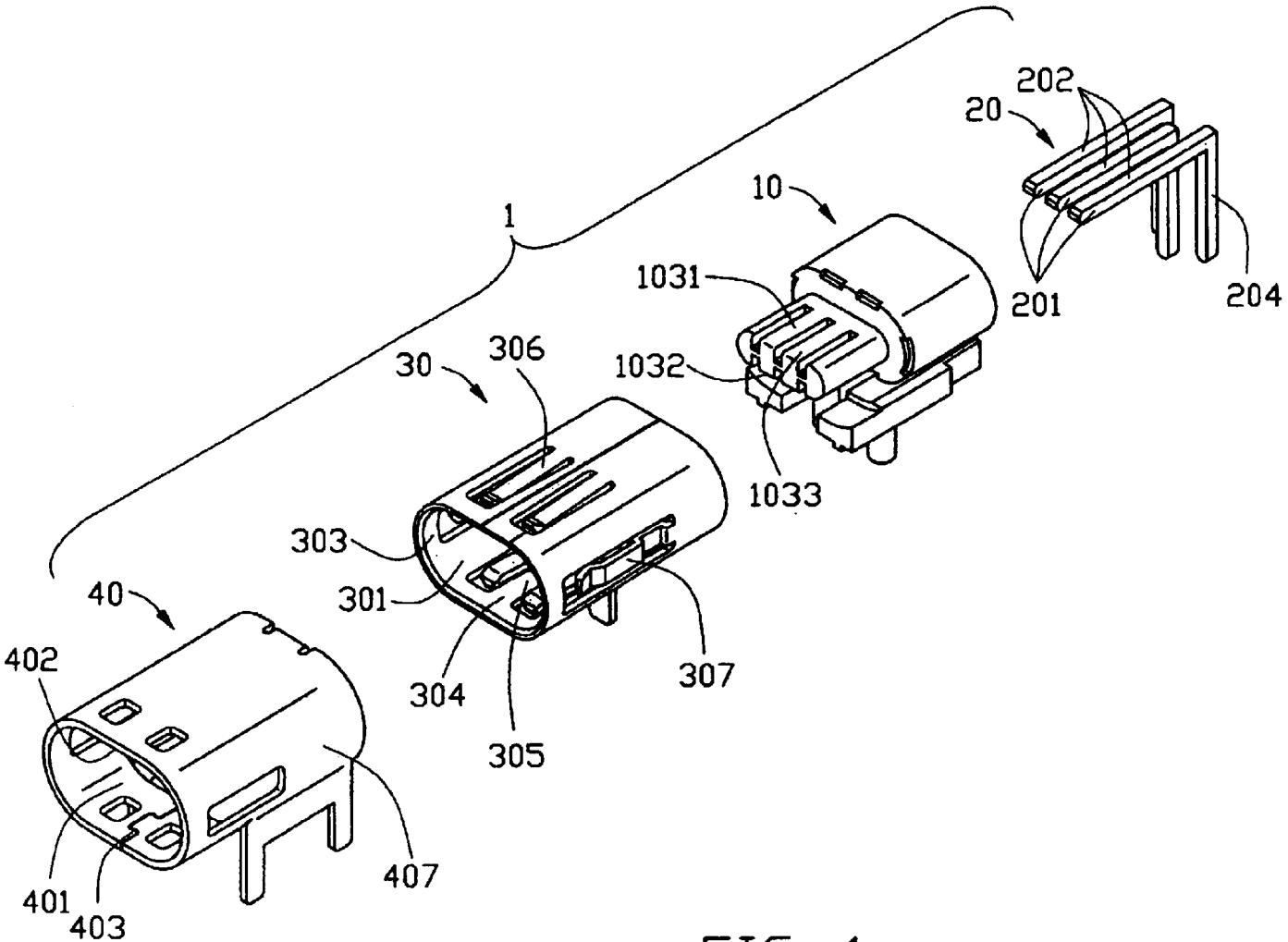
FIG. 1 is an exploded, perspective view of a power connector in accordance with the present invention.

Reference will now be made to the drawing figures to describe the present invention in detail.

Figure 2:
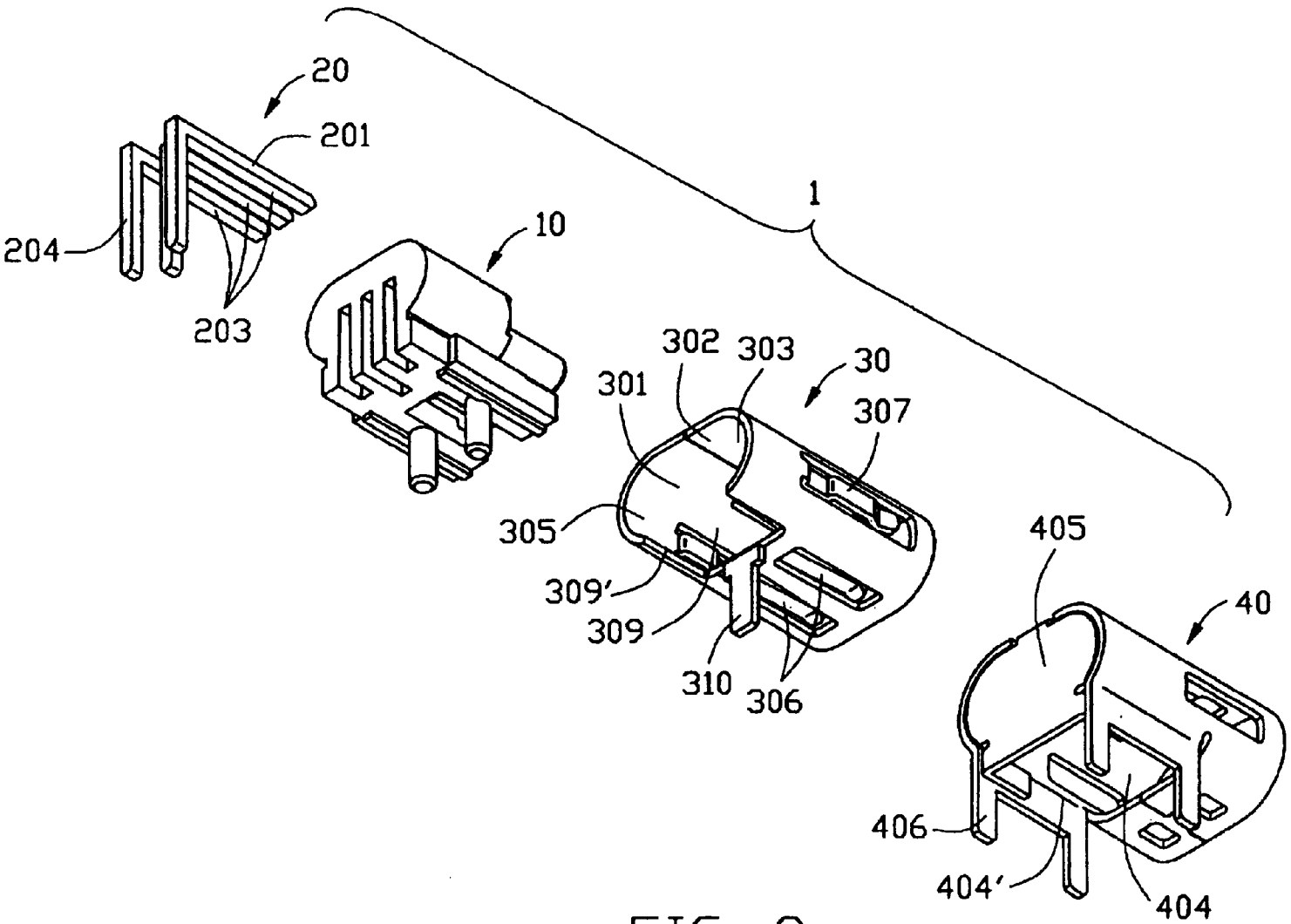
FIG. 2 is a view similar to FIG. 1, but taken from a different aspect.

Referring to FIGS. 1 and 2, a power connector 1 in accordance with the present invention includes an insulating housing 10, a plurality of contacts 20 received in the insulative housing 10 and a conductive shield comprising a first shielding shell 30 and a second shielding shell 40.

Figure 3:
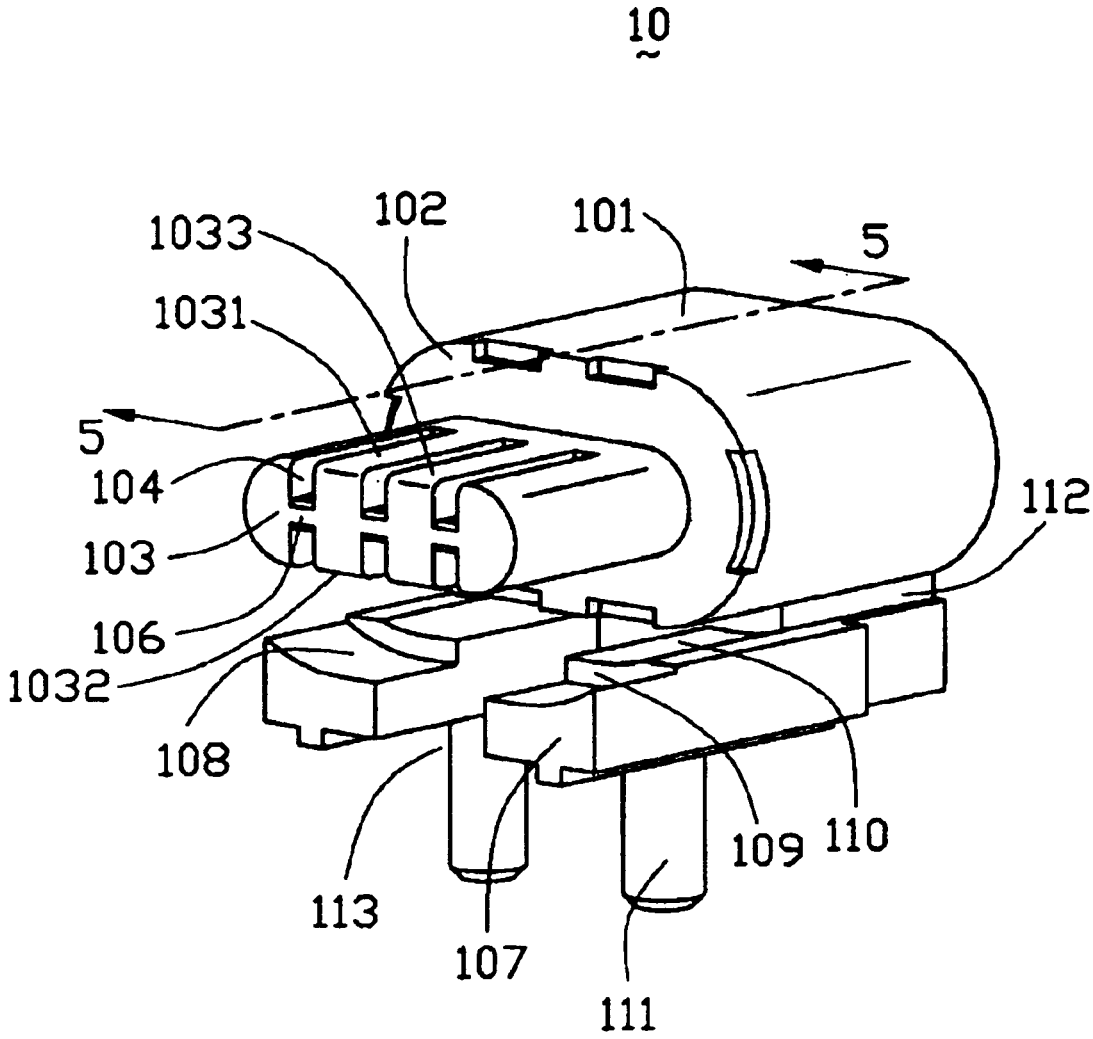
FIG. 3 is a front perspective view of an insulative housing of the power connector.
Figure 4:
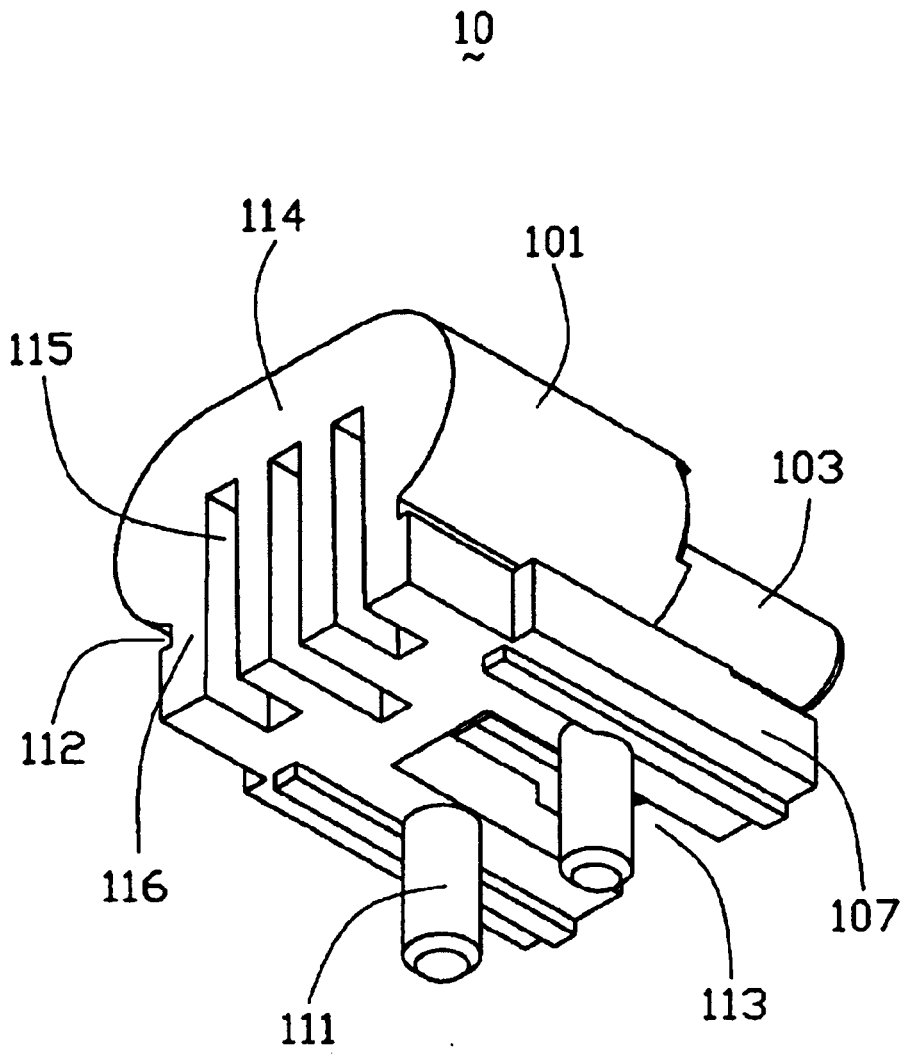
FIG. 4 is a view similar to FIG. 3, but taken from a different aspect.
Figure 5:
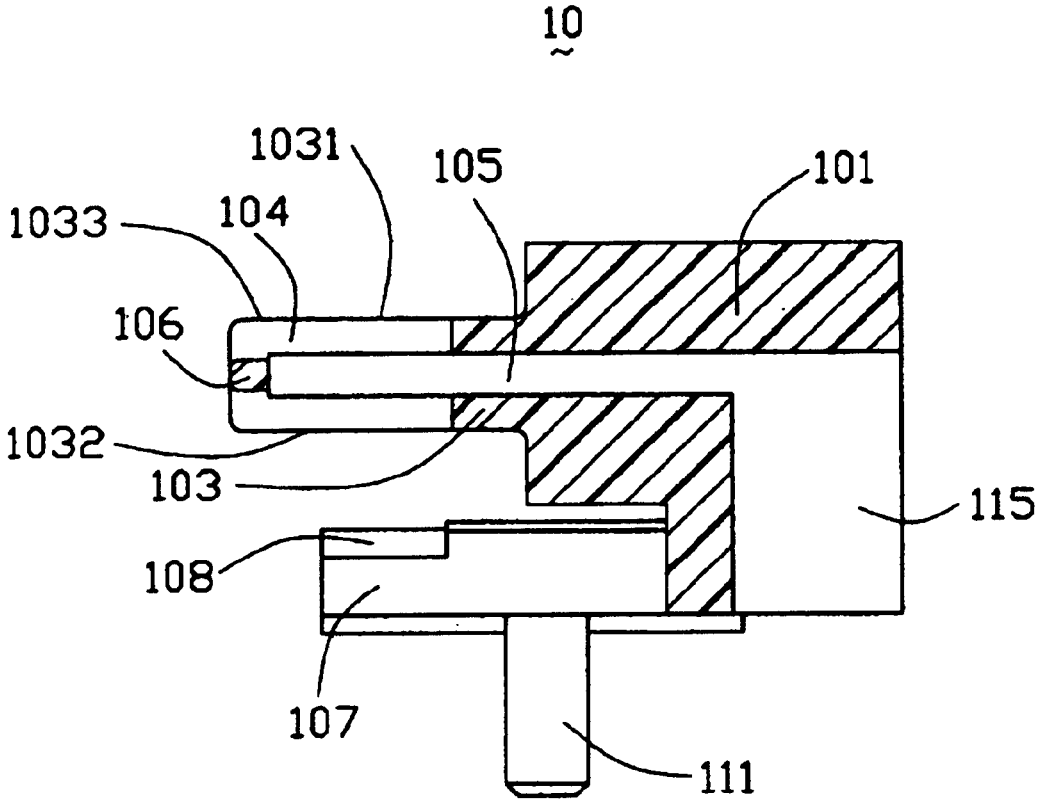
FIG. 5 is a cross-sectional view of the insulative housing taken along line 5—5 of FIG. 3.

With reference to FIGS. 3–5, the insulating housing 10 comprises a base 101, a tongue 103 extending forwardly from the base 101, and two mounting portions 107 below the base 101. The base 101 is about columned-shaped and comprises a front face 102 and an opposite rear face 114. The tongue 103 has an upper mating face 1031 and an opposite lower face 1032. A plurality of receiving slots 104 extend from the upper mating face 1031 to the lower mating face 1032. Each receiving slot 104 defines a stop block 106 thereof exposed to a front surface 1033 of the tongue 103. A plurality of receiving passages 105 are defined through the base 101 toward the tongue 103 to communicate with corresponding receiving slots 104. Correspondingly, a plurality of grooves 115 are defined at the rear face 114 of the base 101 and communicate with the receiving passages 105 respectively. The mounting portions 107 are located adjacent to lateral sides of a bottom of the base 101 and a connecting portion 116 interconnects the mounting portion 107 and the base 101. A guiding groove 112 is formed between the base 101 and the corresponding mounting portion 107. Each mounting portions 107 has a first guiding face 108 and a second guiding face 110 located at a different plane from that of the first guiding face 108, and a step 109 formed between the first and the second guiding faces 108, 110. Both of the first and the second guiding faces 108, 110 are arc-shaped. Each of the mounting portions 107 further has a columnar post 111 extending downwardly from a bottom surface (not labeled) thereof for fixation of the power connector 1 onto a printed circuit board (not shown). A rectangular gap 113 is formed between the two mounting portions 107.

With respect to FIGS. 1 and 2, the first shielding shell 30 is substantially columned-shaped and has a first top wall 302, a first bottom wall 304 opposite to the first top wall 302, and a pair of first lateral walls 303, 305. A first receiving space 301 is formed by the walls 302, 304, 303, and 305. A first opening 309 is defined in a rear portion of the first bottom wall 304. A tab 310 extends downwardly from a front edge (not labeled) of the first opening 309 for fixation of the power connector 1. Both of the first top wall 302 and the first bottom wall 304 have thereon a pair of elastic tabs 306 extending forwardly and extending toward the first receiving space 301. In similar manner, each of the first lateral walls 303, 305 defines thereon an elastic tab 307.

Continue to FIGS. 1 and 2, each contact 20 comprises a horizontally extending contact portion 201 and a mounting portion 204 perpendicular to the contact potion 201. The contact portion 201 has a first contact surface 202 and a second contact surface 203 respectively exposed to the upper and the lower mating faces 1031, 1032 of the tongue 103. However, the contact portion 201 of the contact 20 in the middle is shorter in length than that of the contacts 20 at lateral.

The second shielding shell 40 comprises a second top wall 402, a second bottom wall 403, a pair of second lateral walls 407 and a rear cover 405 extending vertically from the second top wall 402. A second receiving space 401 is formed by the walls 402, 403, 407 and the cover 405. A second opening 404 is defined in the second bottom wall 403. A pair of fixing feet 406 extend downwardly from each lateral edge 404' of the second opening 404.

Figure 6:
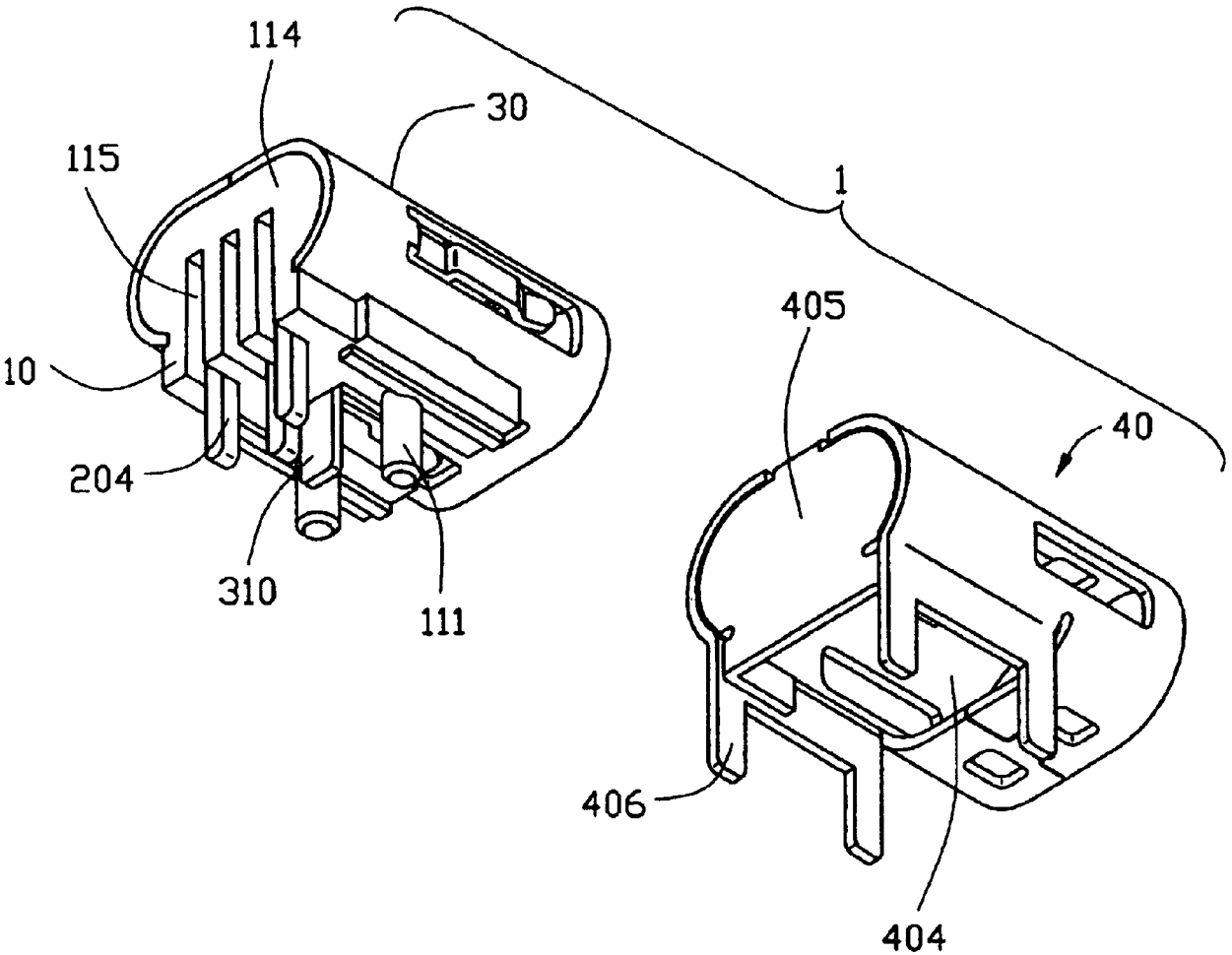
FIG. 6 is a partially assembled view of FIG. 2.

In assembly, as shown in FIGS. 1, 2 and 6, the contact portions 201 of the contacts 20 are correspondingly inserted into the receiving slots 104 until front tips of the contact portions 201 abut against the stop blocks 106 of the tongue 103. Thus, the first and the second contact surfaces 202, 203 of the contact portions 201 are respectively exposed in the first and the lower mating face 1031, 1032 of the tongue 103. The other portions of the contacts 20 are inserted into the receiving passages 105 with the mounting portions 204 of the contacts 20 exposed out of the grooves 115 for being soldered on an electrical circuit board (not shown). Thus, the contacts 20 are surrounded by the insulative housing 10 and distributed along the extension on direction of the receiving passages 105. The contacts 20 are insulated from one another by the plastic material of the insulative housing 10, thereby the accidental shorting therebetween is unlikely to occur.

Then referring to FIG. 6, as the first shielding shell 30 encloses the insulative housing 10, opposite side edges 309' of the first opening 309 are respectively inserted into the pair of guiding grooves 112 until the tab 310 abut against the gap 113 and the first bottom wall 304 abuts against the first guiding face 110 of the mounting portions 107.

Figure 7:
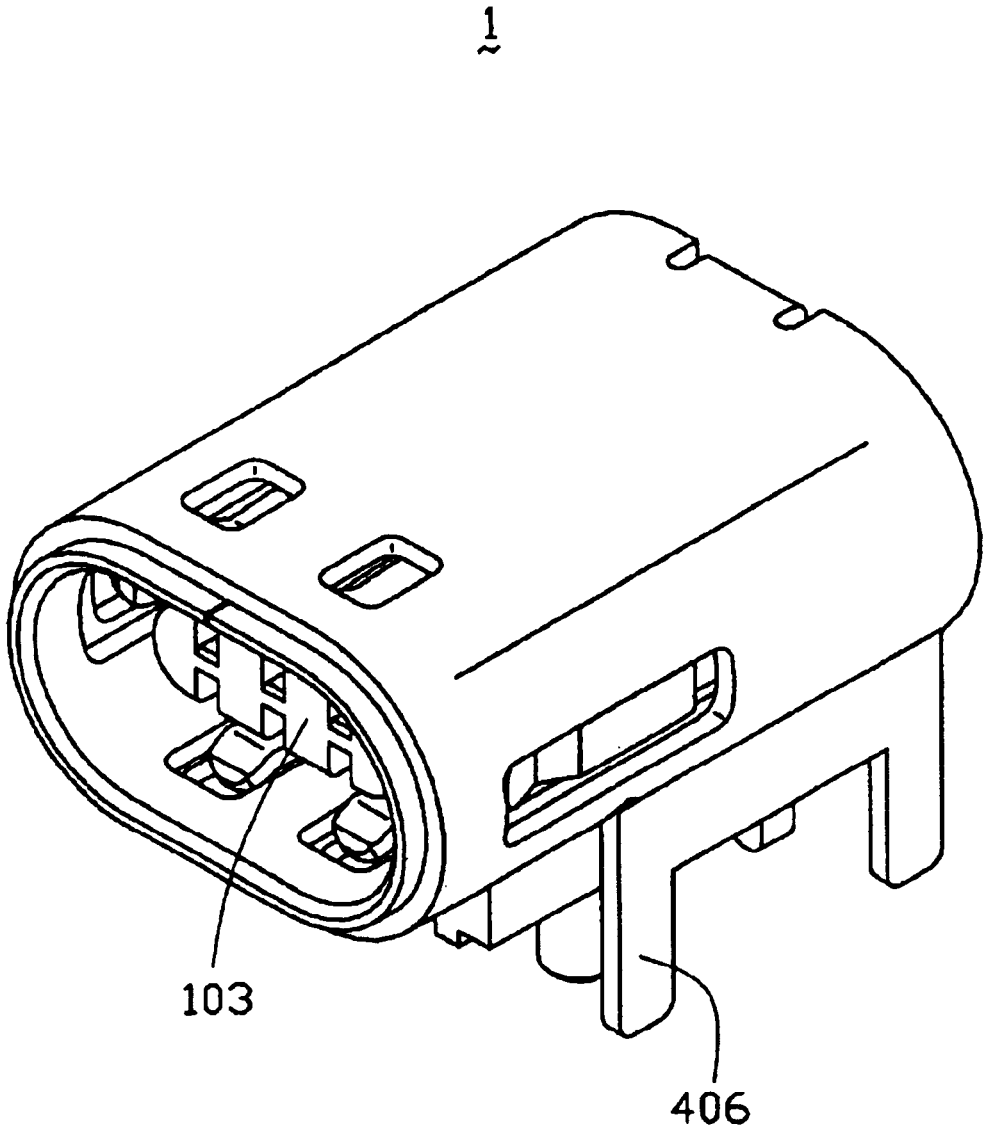
FIG. 7 is a perspective, assembled view of FIG. 1.
Figure 8:
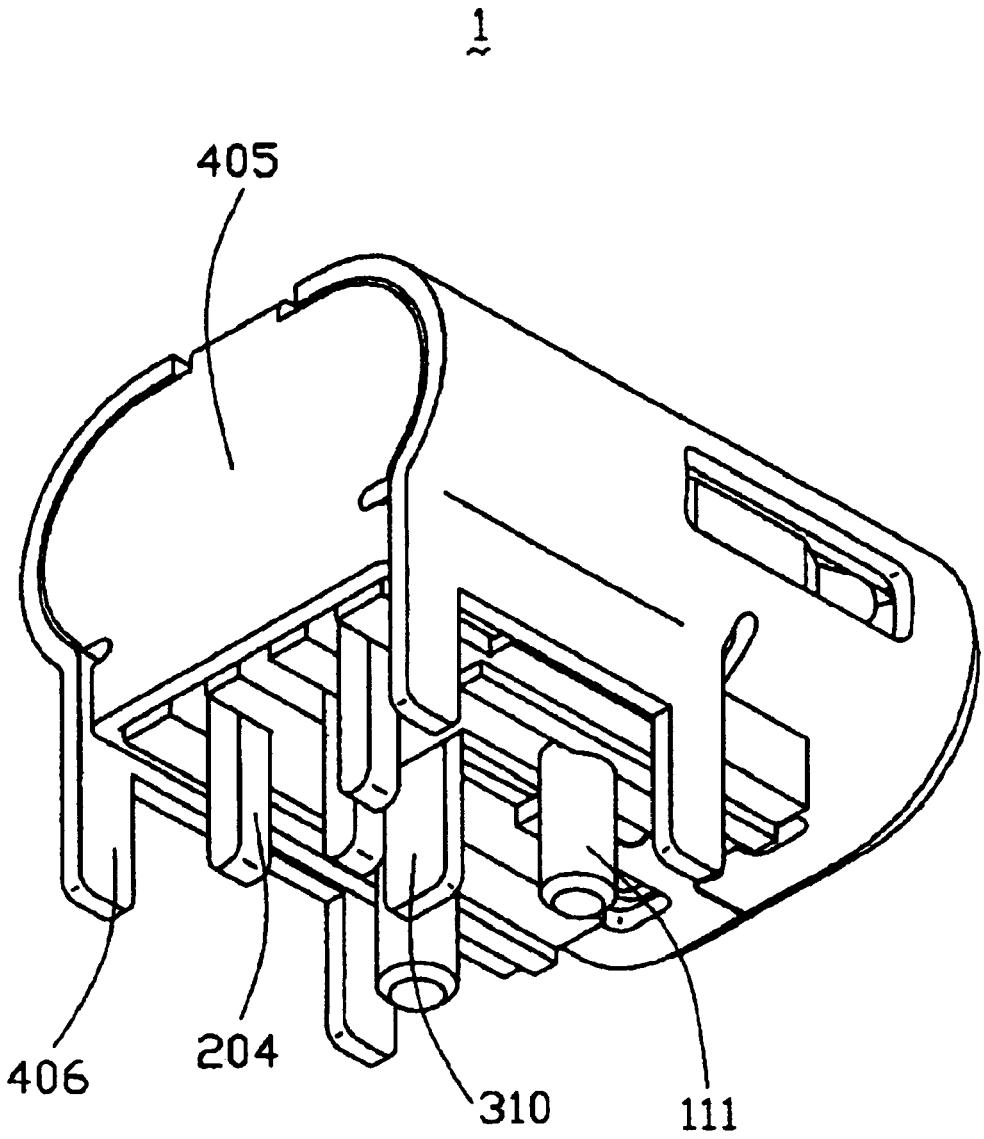
FIG. 8 is a view similar to FIG. 7, but taken from a different aspect.

Turn to FIGS. 7 and 8, as the second shielding shell 40 is arranged to surround the first shielding shell 30 until the lateral edges 404' of the second opening 404 are arranged against the step 109 of the mounting portion 107. The front of the second bottom wall 403 is configured to abut against the second guiding faces 108 of the mounting portions 107. The rear cover 405 now is bent close to the second bottom wall 403 and the second lateral walls 407. The contacts 20, the insulative housing 10 and the first shielding shell 30 are partially received in the second receiving space 401.

When the power connector 1 mates with a complementary connector (not shown), the elastic tabs 306, 307 of the first shielding shell 30 hold the complementary connector under a fixing position, and the first contact surface 202 and the second contact surface 203 of the contacts 20 are clamped by fork-like mating contacts of the complementary connector. Thus, there is a reliable electrical connection between the contacts 20 and mating contacts to ensure the electrical current between the power connector 1 and the complementary connector. When the power connector 1 transmits electrical current, dissipation of electrical power generates heat. The heat is radiated from the surface area of the contacts 20. A larger surface area and a higher mass of the contacts 20 will limit the temperature attained by the contacts 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A power connector comprising:

an insulating housing having a base, and a tongue extending forwardly from the base, the tongue comprising an upper mating face, a lower mating face parallel to the upper mating face and a plurality of receiving slots extending from the upper mating face to the lower mating face, the housing defining a plurality of receiving passages extending through the base and communicating with the slots;

a plurality of contacts each having a contact portion received in a corresponding receiving slot, each contact portion comprising a first contact surface and a second contact surface respectively exposed to the upper mating face and the lower mating face, the first contact surface and the second contact surface are clamped by fork-like mating contacts of a complementary connector; and a conductive shield enclosing the insulative housing;

wherein the base is slotted with a plurality of grooves in a rear face thereof, each groove communicating with a corresponding receiving passage.

2. The power connector as described in claim 1, wherein the tongue of the insulative housing forms a plurality of stop blocks in corresponding receiving slots.

3. The power connector as described in claim 1 wherein the insulative housing forms a pair of mounting portions located below the base and at opposite lateral sides of said base.

4. The power connector as described in claim 3, wherein the insulative housing defines a rectangular gap between the pair of mounting portions and a guiding groove formed between the base and each mounting portion.

5. The power connector as described in claim 3, wherein each mounting portion comprises a first guiding face and a second guiding face, the two guiding faces being located at different planes and forming a step therebetween.

6. The power connector as described in claim 5, wherein the conductive shield comprises a first shielding shell surrounding the insulative housing and a second shielding shell enclosing said first shielding shell.

7. The power connector as described in claim 6, wherein the second shielding shell comprising a top wall and a rear cover bent downwardly from the top wall.

8. A power connector comprising:

an insulating housing having a base, and a tongue extending forwardly from the base, the tongue comprising an upper mating face, a lower mating face parallel to the upper mating face, and a plurality of receiving slots extending along a front-to-back direction with at least an upper portion extending through the upper mating face and at least a lower portion extending through the lower mating face;

a plurality of contacts each having a contact portion received in a corresponding receiving slot, each contact portion comprising a first contact surface and a second contact surface respectively exposed to an exterior through said upper portion and said lower portion, the first contact surface and the second contact surface are clamped by fork-like mating contacts of a complementary connector;

wherein said upper portion and said lower portion are symmetrically formed in the upper mating face and the lower mating face;

wherein said upper portion and said lower portion extend through a front face of said tongue;

wherein said base defines a plurality of passageways in alignment with the corresponding receiving slot, respectively, in the front-to-back direction.

9. The connector as claimed in claim 8, wherein a stop block is formed in a front end of each of said receiving slot on a front face of the tongue.

10. A power connector comprising:

an insulative housing including a base with a tongue extending forwardly therefrom;

a plurality of receiving slot extending in said tongue along a front-to-back direction, said receiving slot basically located in a middle level of the tongue while with upper and lower portions further extending through an upper mating face and a lower mating face of the tongue; and a plurality of contacts each having thereof a blade type contact portion received in the corresponding receiving slot at the middle level, each contact portion comprising a first contact surface and a second contact surface respectively exposed to the upper mating face and the lower mating face, said first contact surface and said second contact surface are generally protected by said upper mating face and said lower mating face while allowing engagement with corresponding fork-like mating contacts of a complementary connector via said first contact surface and said second contact surface.

11. The connector as claimed in claim 10, wherein the receiving slot further extends through a front face except a stop block remaining at the middle level.

* * * * *